United States Patent [19]

Matts

[11] Patent Number: 4,522,635

[45] Date of Patent: Jun. 11, 1985

[54] METHOD AND DEVICE FOR VARYING A D.C. VOLTAGE CONNECTED TO AN ELECTROSTATIC DUST SEPARATOR

[75] Inventor: Sigvard Matts, Växjö , Sweden

[73] Assignee: Flakt Aktiebolag, Nacka, Sweden

[21] Appl. No.: 543,023

[22] Filed: Oct. 18, 1983

[30] Foreign Application Priority Data

Oct. 19, 1982 [SE] Sweden ..... 8205941
Dec. 16, 1982 [SE] Sweden ..... 8207201

[51] Int. Cl.[3] ..... B03C 3/68

[52] U.S. Cl. ..... 55/2; 55/105; 55/139; 323/903; 361/235

[58] Field of Search ..... 55/2, 105, 139; 323/903; 361/235

[56] References Cited

U.S. PATENT DOCUMENTS

| | | | |
|---|---|---|---|
| 3,529,404 | 9/1970 | Quissek | 55/105 |
| 4,160,202 | 7/1979 | James et al. | 55/105 |
| 4,232,355 | 11/1980 | Finger et al. | 55/139 |
| 4,311,491 | 1/1982 | Bibbo et al. | 55/105 |
| 4,326,860 | 4/1982 | Laugesen | 55/105 |
| 4,354,860 | 10/1982 | Herklotz et al. | 55/105 |
| 4,413,225 | 11/1983 | Dönig et al. | 55/105 |

FOREIGN PATENT DOCUMENTS

| | | | |
|---|---|---|---|
| 71592 | 2/1983 | European Pat. Off. | 55/105 |
| 76778 | 6/1977 | Japan | 55/105 |
| 112579 | 10/1978 | Japan | 55/105 |
| 952316 | 3/1964 | United Kingdom | 55/105 |
| 1424346 | 11/1973 | United Kingdom | 55/105 |

OTHER PUBLICATIONS

Senichi Masuda et al., A Pulse Voltage Source for Electrostatic Precipitators, Conference: Industry Applications Society, IEE-IAS 1978, Annual Meeting, Toronto, Ontario, Canada, (Oct. 1-5, 1978), pp. 23-30.

*Primary Examiner*—David L. Lacey
*Attorney, Agent, or Firm*—Dann, Dorfman, Herrell & Skillman

[57] ABSTRACT

A method and device for varying a d.c. voltage connected to an electrostatic dust separator so as to render more effective, in return for a low consumption of energy, the collection of dust on an electrode or electrodes incorporated in the dust separator. The d.c. voltage is set to a first level (basic level), said level having superimposed on it a number, in each case two or more, of voltage pulses forming a pulse group, with the consecutive pulse groups being separated from each other in a time sequence and supplied to electrodes incorporated in the dust separator. A pulse generating device is so arranged as to generate a number of pulses making up a pulse group, whereby the first pulse (21) in said pulse group is selected so as to exhibit an amplitude and/or a duration and/or a form such that, when the pulse is supplied to the dust separator, it will not cause flash-over but will produce an increase in the tendency to flash-over (20') of the dust separator, in conjunction with which the immediately following pulse (22) in the pulse group is selected so as to exhibit an amplitude and/or a duration and/or a form such that, when the pulse is supplied to the dust separator, it will not cause flash-over in spite of the increased tendency to flash-over (20') caused by the preceding pulse, and so on.

26 Claims, 9 Drawing Figures

Fig. 1
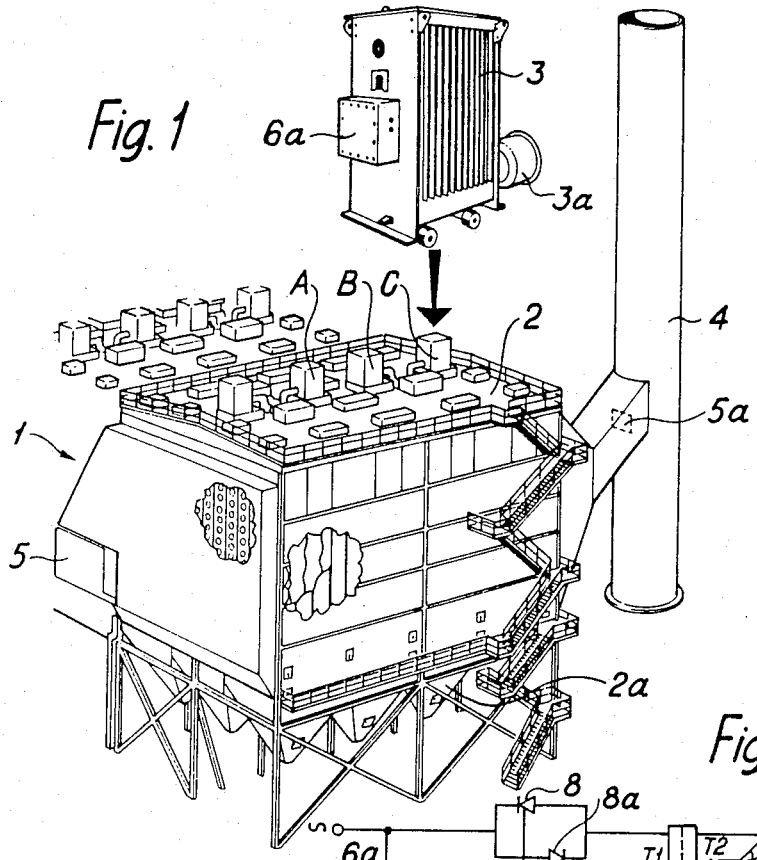
Fig. 2
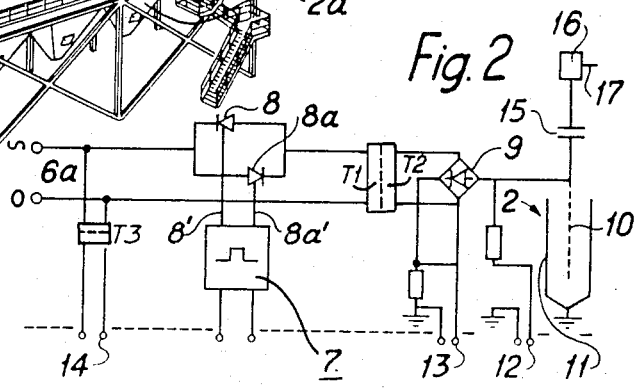
Fig. 3
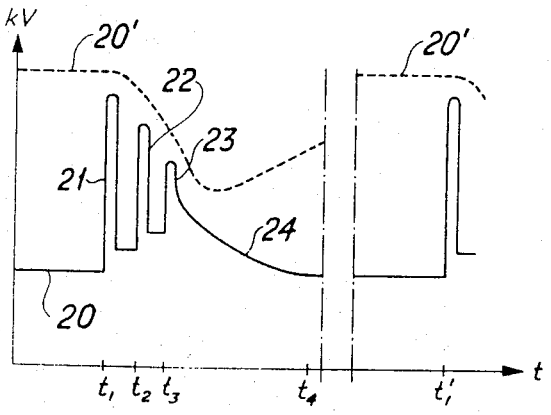
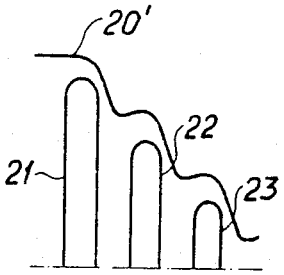
Fig. 3a

METHOD AND DEVICE FOR VARYING A D.C. VOLTAGE CONNECTED TO AN ELECTROSTATIC DUST SEPARATOR

TECHNICAL FIELD

The present invention relates both to a method and to a device for varying a d.c. voltage connected to an electrostatic dust separator intended, in return for a low consumption of energy, to enable the collection of dust on an electrode or electrodes incorporated in the dust separator to be rendered more effective. The d.c. voltage must be set to a first level, the so-called basic level, said first level having superimposed on it a number, in each case two or more, of pulses forming a pulse group. At appropriate intervals of time these pulse groups are transmitted so as to form a pulse train, with the interval of time between two consecutive pulse groups in the pulse train being selected so as to be greater than the duration of pulses within the respective pulse group.

Although the basic level of the d.c. voltage must in itself be variable, so as to permit the filter voltage to be adjusted to a value such that the level of d.c. voltage will not require any current, i.e. until the so-called onset level or the voltage level for 'corona start' is reached, the present invention nevertheless assumes, in the interests of simplicity, that the level of d.c. voltage remains constant and is set to a pre-determined level, referred to below as the first level.

DESCRIPTION OF THE PRIOR ART

Electrostatic dust separators of the nature described above are in themselves already familiar. U.S. Pat. No. 4,138,233 proposes various possibilities for superimposing pulses on a first level of d.c. voltage or for connecting various a.c. voltages to said level of d.c. voltage, thereby attempting to render the dust separation more effective.

Also previously disclosed is the procedure of superimposing individual pulses on the d.c. voltage, selecting a large time window between the individual pulses, and of trying to store in a storage capacitor any energy returned from the individual pulse. As an example of the prior art, reference may be made in this respect to the arrangement illustrated and specified in Swedish Patent Application No. 76 02263-1, which corresponds to U.S. Pat. No. 4,052,177 and proposes a circuit for an electrostatic dust separator, incorporating a d.c. circuit, for producing a d.c. voltage which is supplied to a capacitor constituted by the electrodes of the dust separator. Also proposed in an a.c. circuit in the form of a pulse generator, incorporating a storage capacitor, for producing a superimposed a.c. voltage. Inductive devices are provided for this purpose and are connected between the storage capacitor and the capacitor constituted by the electrodes of the dust separator, enabling an a.c. voltage on which has been superimposed the d.c. voltage to be supplied to the electrodes of the dust separator. In order to achieve a reduction in the power requirement of such an electrostatic dust separator, the Swedish Patent Application proposes an LC oscillating circuit formed by the storage capacitor, the inductive device and the capacitor constituted by the electrodes of the dust separator, together with non-linear electrical components to control the LC oscillating circuit. These non-linear electrical components are so controlled and are so arranged as to be capable of transferring back to the storage capacitor, for renewed storage there, a major part of that energy which was transferred during each pulse to the capacitor constituted by the electrodes of the dust separator.

DESCRIPTION OF THE PRESENT INVENTION

Technical Problem

It has been found in conjunction with the operation of electrostatic dust separators that the operating conditions may be dependent to a very high degree on the nature of the dust intended for separation.

It may also be stated that instances of flash-over in the dust separator, which are not in themselves undesirable, may occur either between the electrodes or in the layer of dust which has attached itself to one of the electrodes.

In particular in the latter case, which is applicable to certain dusts, it has been found to be necessary, in view of the latent inclination or tendency to flash-over, to operate the dust separator with a sufficiently low current being supplied to the electrodes of the dust separator for the current strength to be incapable of maintaining a sufficient current distribution to all parts of the electrode system.

Previously disclosed technology, of which some is described above, has enabled short-duration pulsing to be used to supply a sufficiently high current for good distribution of the current to the entire system to be assured without flash-over occurring in the dust layer.

In the first case, where the risk of flash-over between the electrodes is present, it has proved possible to make use of pulsing in order momentarily to increase the current over and above the value which would produce flash-over for a gentle increase in the current.

The common principles relating to the two aforementioned possibilities are based on the knowledge that it is possible for short periods momentarily to increase the current to the electrodes, when the amplitude of the current may be set very much higher than the current which would produce flash-over with a pure d.c. supply. In connection with this, the duration of the current pulse must be selected to be so short that flash-over is not able to occur.

A large number of measurements taken from electrostatic dust separators which are already in use has produced indications to suggest that a further number of current pulses generated in close sequence after the first pulse should be able to produce a further improvement in the quantity of dust deposited.

An interpretation of the results of measurements which have been made and theoretical considerations lead to the following conclusions.

When in operation, and when the d.c. current is present only at its basic level, every dust separator will have a latent inclination or tendency to flash-over, this being dependent on whether the d.c. current is gently increased or whether the d.c. current is supplied in the form of short pulses at high amplitude. Flash-over is, in fact, to be expected for a certain increase in the d.c. current, although flash-over may be expected to occur at a considerably higher d.c. current value if the d.c. current is supplied to the electrodes of the dust separator in the form of pulses.

The first current pulse in a pulse group must, therefore, be selected with the highest possible amplitude before flash-over occurs. However, this current pulse will produce, amongst other things, charges on any dust particles present in the dust separator, with the result that these charged particles will increase the inclination or tendency to flash-over, which means in practical terms that flash-over may be expected to occur at a lower amplitude than that selected for the first pulse. If, therefore, during the period when the increased inclination or tendency to flash-over is still present in the dust separator, a new and identical pulse is supplied to the dust separator, flash-over from this pulse could very likely occur.

Technical Problem

With reference to the above, a major technical problem has been encountered in connection with controlling those pulses which are to make up a pulse group in such a way that, on the one hand each and every one of them does not produce flash-over between the electrodes of the dust separator in spite of the increased tendency to flash-over inside the dust separator for each pulse, and on the other hand is selected so as to contain the appropriate maximum quantity of energy for effective dust separation.

A further major technical problem is at the same time to create conditions such that the generation of each and every one of the pulses in the pulse group may take place in a simple fashion utilizing simple control curcuits.

A major technical problem is encountered in connection with the creation of simple conditions for generating a pulse train with periodically recurring pulse groups, with every pulse in the pulse group exhibiting the aforementioned requirements utilizing simple control circuits.

A major technical problem is associated with the implementation of measures such that each pulse in the pulse group will have a chronologically decreasing amplitude, and such that the amplitude of each pulse is adjusted so as to be less by only a small amount than the instantaneous flash-over value which is applicable to the dust separator at the point in time when the actual pulse occurs.

A technical problem is associated with the creation of conditions such that the electrostatic dust separator may be supplied with a pulse group containing a number of pulses, in which the minimum number of pulses is two, and with each pulse having a relatively high energy content and yet still lying below the flash-over value.

A fundamental technical problem encountered in electrostatic dust separators of the aforementioned nature is that these consume an extremely large amount of energy. Considerable interest has been shown for some time, therefore, in finding ways to reduce the energy requirement and the power requirement needed to separate a pre-determined quantity of dust.

The actual nature of the problem is not, therefore, to be able for each pulse to recover a certain quantity of energy and to utilize that recovered quantity of energy in the next pulse, since efforts in this direction will not necessarily lead to a high level of efficiency, i.e. to a high value for the following relationship $$\frac{\text{total quantity of dust deposited}}{\text{total energy consumption}}$$

during one and the same interval of time, at the same time as the cost of the filter is kept low.

The problem is, of course, made more difficult by the hard-to-define fact that, in order to achieve the maximum level of purification for the minimum consumption of energy, a given dust will require certain special voltages and/or voltage variations to be provided inside the electrostatic dust separator. One other factor which may possibly need to be considered is that a particular dust may call for specially designed electrodes. It is practically impossible, therefore, to adapt the design of the electrostatic dust separator and to regulate the supplied voltages and voltage variations to suit a particular dust in such a way as to achieve a maximum level of efficiency, the question which arises being rather to attempt to minimize the negative effect of the compromises which are made.

Against this background, therefore, one major technical problem which arises is associated with the attempt to find an easily accessible solution to the aforementioned problems, said solution being based more or less on ignoring mechanical modifications to the electrostatic dust separator and to the design of the electrodes which it contains, and on concentrating instead on various methods of varying the voltages which occur inside the dust separator.

Solution

The present invention proposes firstly a method and secondly a device for varying a d.c. voltage connected to an electrostatic dust separator in such a way as to render more effective in return for a low consumption of energy the collection of dust on an electrode or electrodes incorporated in the dust separator. On the aforementioned first level are superimposed two or more voltage pulses forming a pulse group, with the consecutive pulse groups being separated from each other in time and applied to electrodes incorporated in the dust separator with a time interval between the applications.

A fundamental characteristic of the invention is that the first pulse in said pulse group is selected so as to exhibit an amplitude and/or a duration and/or a form such that, when the pulse is transferred to the dust separator, its energy content will not cause flash-over but will otherwise lie with its energy content immediately below the flash-over level. This pulse will increase the tendency to flash-over of the dust separator. The immediately following pulse is selected so as to exhibit an amplitude and/or a duration and/or a form such that, when the pulse is transferred to the dust separator, its energy content will not cause flash-over, in spite of the increased tendency to flash-over produced by the previous pulse, and so on. The second and following pulses should then be selected so as to exhibit an energy content immediately below the actual flash-over level.

It is particularly advantageous if each pulse in the pulse group can be selected so that its energy content is only slightly below the energy content which would have produced flash-over at the actual level of tendency to flash-over.

From the practical point of view it should be sufficient to select the first pulse in the group such that it exhibits an energy content which exceeds the energy content of the immediately following pulse in the pulse group, and so on.

The invention also proposes that the instantaneous d.c. voltage value or the amplitude for each pulse within a pulse group be allocated successively declining values. The present invention also proposes that the interval of time between immediately consecutive pulses within the pulse group and the amplitude of each pulse be capable of being regulated so as to permit these parameters to be adjusted to suit the nature of the dust or the dust mixture which is present, in order to achieve a high proportion of deposited dust in return for low energy consumption.

The present invention relates in particular to the characteristic that the pulses within the pulse group may be generated by means of an oscillating voltage superimposed over the value of the d.c. voltage, in which case said superimposition shall take place in such a way that at least a part of the oscillating voltage lies above the first level of the d.c. voltage. If the oscillating voltage is selected in such a way that it is a damped oscillating voltage, for example generated via a subcritically damped LC circuit in which the capacitance of the dust separator represents a major proportion of the capacitance value of the oscillating circuit, it is recommended that a large or small part of a decaying component of the oscillating voltage may be clipped with the intention of reducing the energy consumption and of simplifying the control circuit. Since an increase in the d.c. voltage inside the dust separator caused by the pulse group, and occurring in time after the pulse group, will require a current to flow through the dust separator, it is recommended that this increased d.c. voltage value be permitted to fall to the set first level for the d.c. voltage before further pulses within the pulse group are activated. The energy consumption of the pulses should be selected so as to occur in the form of an oscillation between the capacitance of the dust separator and an inductance and possibly a capacitance which do not belong to the dust separator.

Advantages

The advantages which may principally be regarded as being associated with a method and a device in accordance with the present invention are the opportunities which are afforded for being able in a very successful fashion to select various parameters relating to connected voltage pulses and pulse trains and to utilize the total amount of energy in the pulses in such a way that the energy consumption, in relation to a pre-determined individual quantity of dust or degree of purification, may be reduced experimentally to a low level.

DESCRIPTION OF THE DRAWINGS

A preferred embodiment exhibiting the significant characteristic features of the present invention is described below in greater detail with reference to the accompanying drawings, in which:

FIG. 1 shows in perspective view a dust separator incorporating a large number of units connected together one after the other (in series), but with only one transformer/rectifier unit intended for one unit shown raised above the rest of the dust separator;

FIG. 2 shows a block diagram for the transformer/-rectifier unit;

FIG. 3 shows a voltage/time diagram for a pulsed d.c. voltage within the context of the invention;

FIG. 3*a* is an enlarged view showing the tops of the pulse group illustrated in FIG. 3;

DESCRIPTION OF THE PREFERRED EMBODIMENT

Figure 4A:
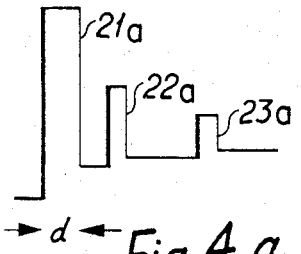
FIGS. 4*a* and 4*b* show a voltage/time diagram for two different embodiments of pulse variations within a pulse group within the context of the invention.

FIG. 1 thus shows the perspective view an example of an electrostatic dust separation plant 1, consisting of a large number of parallel flue gas chambers, each of which is equipped with four groups of electrodes. One transformer/rectifier unit is required for each and every one of these electrode groups, although in FIG. 1 only that unit which is intended for the electrode group of the final separator 2 of the plant 1 is illustrated and has been given the reference designation 3. The positioning of the electrode groups is in principle such that the outlet from one group is connected directly to the inlet for the following group, and so on. Since the group in separation 2 is the last group, its outlet is connected to a chimney 4.

Although what is illustrated here is a dust separator plant consisting of separators having a number of electrode groups, there is nothing to prevent each group from consisting of a single electrostatic dust separator.

The dust separation plant 1 is of the type in which air contaminated with particles is fed into an inlet 5 and is caused to flow past the first group of electrodes. In this, as in the other groups of electrodes, the particles are electrically charged by the electrical field which is formed between adjacent plate electrodes and interjacent emission electrodes by connecting a high d.c. voltage to the emission electrodes. A particle of dust which comes into this field will be given an electrically negative charge and the particle will then be attracted by the positive plate electrode and will be repelled by the negative electrode, thereby causing the particles to be attracted towards the plates. The air which has thus been purified by one electrode group after another will then pass out through the outlet 5*a* to the chimney 4.

Electrically charged particles of dust will be caused by the electrical field to attach themselves principally to the plates, where they will build up into a layer. Once this layer reaches a certain thickness, the layer is shaken from the plates mechanically and falls down. Particles which have gathered in the dust separator 2 will thus normally collect in collecting boxes formed in the base 2*a* of the dust separator or in a particle-collecting unit.

FIG. 2 shows a simplified connection diagram for a transformer/rectifier unit, from which it may be appreciated that an a.c. supply cable 6*a* is connected to two opposing thyristors 8, 8*a*, each provided with its own control electrode connector 8′, 8*a*′ which are connected to the control device 7, which is represented diagrammatically but is not described in greater detail in FIG. 2.

Control device in themselves are already familiar, although it may be a control device of this kind which is described in greater detail in U.S. patent application Ser. No. 398,654, now U.S. Pat. No. 4,486,704, which is commonly owned with the present application. It will, of course, be necessary in this case to adapt the program to suit the special characteristics of the dust to be separated and the configuration of the electrodes.

In this way control is achieved over the current through an inductance incorporated in a transformer winding T1. The primary transformer winding T1 interacts with the secondary transformer winding T2, which is constituted by the high-voltage side, and is connected to a rectifier bridge 9 connected to the high-voltage side. To the emission electrode 10 in the dust separator 2 is connected the negative voltage, which may be regarded as being rectified and equalized on the basis of the capacitance which exists between the grounded plate electrode 11 and the emission electrode 10.

The control device 7 requires information relating to instantaneously occurring d.c. voltage and d.c. current values in order to be capable of controlling the d.c. voltage value inside the dust separator. The instantaneous d.c. voltage value can be measured via a conductor 12, whereas the instantaneous d.c. current value can be measured via a conductor 13. The passages through zero of the measuring a.c. voltage can be measured via a conductor 14.

The principal function, in accordance with FIG. 1 and FIG. 2, of the control device is therefore the sequential control of the signals on the connectors 8' and 8a' so as to be able to regulate the level of the d.c. current and/or d.c. voltage values in the separator 2, in such a way that the d.c. voltage value there is set to a pre-determined first level. This first level is in itself variable and must always be set high, although only sufficiently high for the level to be adjusted so that the dust separator does not require any current. This level is referred to as the 'on-set' or as the voltage value for 'corona start'.

A circuit equivalent to that in accordance with FIG. 2 is thus connected to each and every one of the various electrode groups which make up the installation or plant 1.

To the electrostatic dust separator 2 is also connected a coupling capacitor 15 connected to a pulse generating device 16, said device being triggered at time intervals by pulses occurring in a conductor 17, said pulses also being so arranged, including the times when they are to occur, as to be initiated from the control device 7.

Information relating to the degree of purification of the quantity of air released can be measured by means of a sensor in the outlet 5a, which should preferably be connected directly to the control device 7 in accordance with FIG. 2.

The control device 7 can be programmed so as to vary one or more parameters of the generated pulses via the device 16 and then to measure the result by means of the sensor in the outlet 5a.

In the event of a poorer result being recorded for a change initiated by the control device 7, the control device will issue instructions to return to the previous setting, and in the event of an improved result being recorded, the control device will issue instructions to advance by a further setting in the same direction for the same parameters. Once the maximum level of efficiency has been reached in this way for the actual parameters set, the control device 7 will begin to regulate another parameter in a similar fashion.

FIG. 3 shows a voltage/time diagram in which a plurality of d.c. voltage pulses is caused to be superimposed onto a d.c. voltage value set to a pre-determined first level 20. According to FIG. 3, at the time t1 the first level 20 will have superimposed on it a d.c. voltage pulse 21, said pulse being of short pulse width, said pulse also exhibiting an instantaneous or peak d.c. current value such that it will fall below by only a small amount a second d.c. voltage level 20' in the dust separator. The second d.c. voltage level 20' can be the level which would cause flash-over between the electrodes incorporated in the electrostatic dust separator, were the peak amplitude of the pulse 21 to have exceeded that level. However, the pulse 21 will produce a change in that level inasmuch as the pulse will increase the tendency to flash-over of the dust separator, which is illustrated by the declining curve 20' indicating the flash-over voltage after the pulse 21. In other words the peak energy content of each pulse is selected so that it exceeds by only a small amount the energy content which would cause flashover if applied as a d.c. supply. Preferably the pulse width or duration of the pulse is not greater than the interval between successive pulses in the group.

FIG. 3a shows on a somewhat enlarged scale the variation in the inclination to disruptive discharge under the effect of the pulses. Each pulse produces an increase in the tendency to flashover, i.e. a lower flash-over voltage value 20', which is reduced slightly after the pulse and until the next pulse contributes to a new increase in the tendency to flashover.

According to FIG. 3, a further instantaneous d.c. voltage pulse 22 will be generated at the time t2, and yet another pulse 23 will be generated at the time t3, whereupon the voltage in the dust separator which has been built up or raised by the pulses 21, 22, 23 is allowed to fall along a curve 24 until the time t4 is reached. A new group of pulses can be generated at the time t1. It may be seen from FIG. 3 that the peak amplitude of the pulses 21, 22, 23 should always be selected so as to lie below the curve 20', and preferably immediately below it, so as to achieve the greatest possible transfer of energy from the pulses to the dust separator.

When the pulse group 21, 22 and 23 is completed, the curve 20' for the flash-over voltage 20' will increase once more to its previous level.

It is important in this respect for the practical operation of the device that, in particular, the amplitude of each of the pulses and frequency of repetition of the pulses, and if possible also their duration, be selected with care. It should be possible to select these parameters such that only a small increase in the voltage will occur in the dust separator after the pulse group is completed.

Figure 4B:
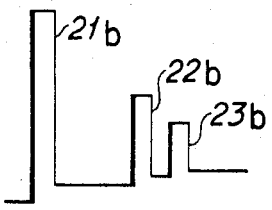

FIGS. 4a and 4b show the voltage/time diagram for two different embodiments of pulse groups, each of which contains three pulses.

With regard to the duration d of the pulses, this in itself is variable, although it has been found that it should preferably lie within the range 50–250 $\mu$s, and that the interval of time between two consecutive pulses in a pulse group should lie within the range 50–500 $\mu$s.

FIG. 4a shows an example of a pulse group in which the duration of the pulse for the first pulse 21a has been selected so as to exhibit a longer duration than the other pulses 22a, 23a within the pulse group, and also that the interval of time between the first (21a) and the second (22a) pulses has been selected so as to be considerably less than the interval of time between the second (22a) and the third (23a) pulses.

FIG. 4b shows that the pulse duration or pulse width for each pulse within the pulse group has been selected so as to be identical, but that the interval of time between the first (21b) and the second (22b) pulses has been selected so as to be considerably greater than the interval of time between the second (22b) and the third (23b) pulses.

The fact that the pulses in the pulse train have been selected to be three in number produces a convenient number of pulses, although it is clear that the number may vary without departing from the idea of invention. A larger number of pulses may be used to advantage under practical operating conditions, and a fully decaying oscillation may also be used.

Figure 5:
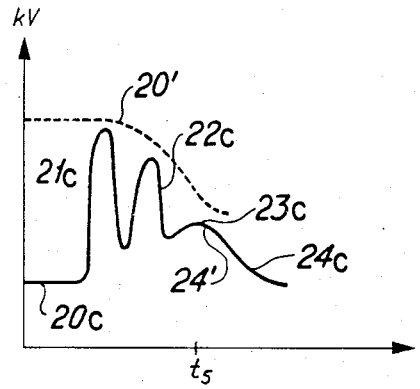
FIG. 5 shows a voltage/time diagram when a damped oscillating voltage is superimposed on the d.c. voltage, set to a first pre-determined level.

FIG. 5 shows a voltage/time diagram in which the pulses are generated by superimposing an oscillating voltage over the d.c. voltage value 20*c*. This superimposition takes place in such a way that the whole of the oscillating voltage will lie above the d.c. voltage value 20*c*. The peak value for the oscillating voltage, in particular the first or the second oscillations, must lie below the aforesaid second d.c. (flashover) voltage level 20' by a certain amount.

FIG. 5 also shows that the oscillating voltage is selected so as to be a damped oscillating voltage and that the greater or smaller proportion of a decaying component (not shown in the Figure) of the oscillating voltage is clipped at the time t5, whereupon the increased voltage, which bears the reference designation 24*c* as the voltage 24 in FIG. 3, is permitted to decay until it reaches the first set d.c. voltage level 20*c*.

The increase in the d.c. voltage 24' produced in the dust separator by the pulse group after the occurrence of all of the pulses 21*c*, 22*c* and 23*c* in the pulse group is permitted to fall to the level of the set d.c. voltage 20*c* before further pulse groups are activated.

FIG. 5 shows how each pulse within the pulse group is generated via a subcritically damped LC circuit in which the capacitance of the dust separator constitutes an essential part of the capacitance value of the oscillating circuit.

The duration and amplitude of the pulse can be selected by selecting corresponding values for the LC circuit. The capacitance and the inductances can thus be introduced as separate entities (not belonging to the dust separator) if these are not accessible in any other way.

Figure 6:
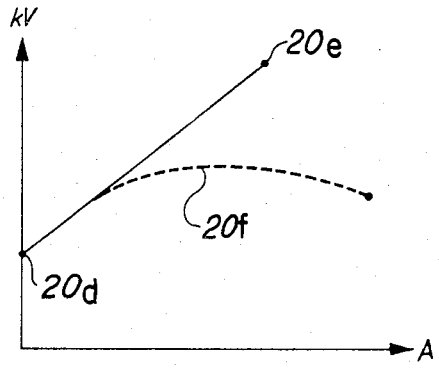
FIG. 6 shows a voltage/current diagram which is generally applicable to an electrostatic dust separator.

FIG. 6 shows a voltage/current diagram which is applicable to an everyday dust separator, and from which it may be appreciated that, when the voltage increases above the first level (the 'on-set' level), the electrostatic dust separator will require a certain current value above the onset level as indicated by the sloping line originating at the point 20*d*. Consequently, it is desirable to keep the voltage level immediately below the voltage at point 20*d* at which the need for current to be consumed arises. The line to point 20*e* indicates the current and voltage levels for a certain dust composition and dust concentration where flashover occurs, and the broken line 20*f* indicates the current and voltage levels which result when an increase in current does not produce a corresponding incrase in voltage, as evidenced by the leveling off of the curve 20*f*. The voltage actually drops as the current approaches its maximum value.

Figure 7:
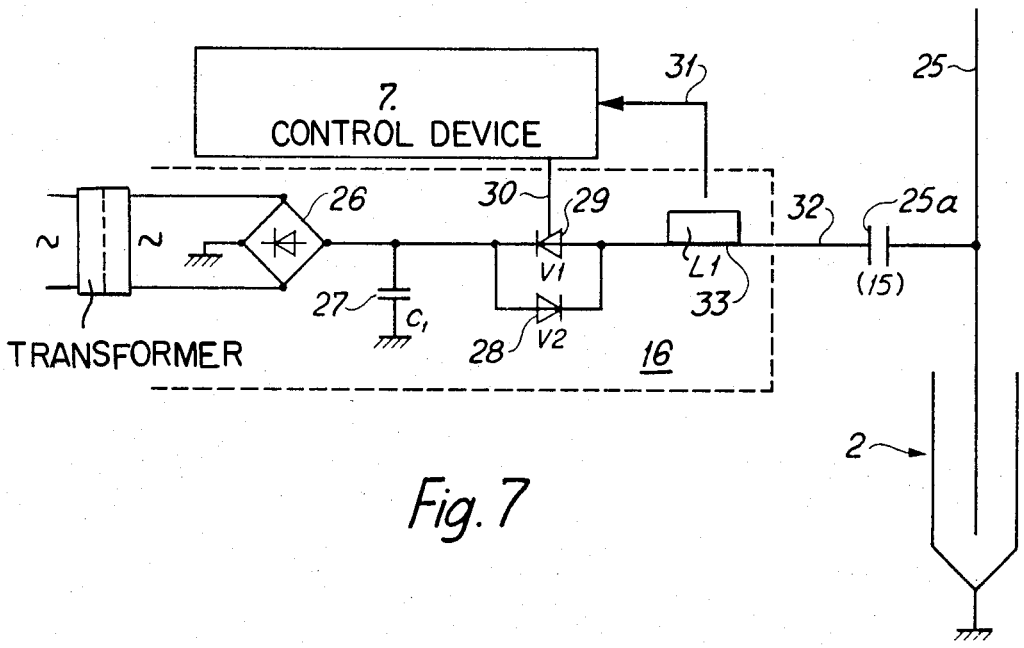
FIG. 7 shows a simplified connection diagram in the form of a block diagram enabling the requirements in accordance with FIG. 5 to be met.

FIG. 7 shows in diagrammatic form a connection diagram for a supply circuit belonging to an electrostatic dust separator 2, to which is connected on the one hand an adjustable d.c. voltage via the conductor 25 for the purpose of adjusting the first d.c. voltage level in the separator 2, and on the other hand via a coupling capacitor 25*a* a d.c. voltage pulse-generating circuit in a device 16, incorporating a diode bridge 26, a capacitor 27 and a diode 28 and a thyristor 29., The latter is controlled via a conductor 30 by the control device 7, and a monitoring circuit 31 for measuring the number of pulses which pass along the conductor 32 to the electrostatic dust separator 2.

The pulses 21*c*, 22*c* and 23*c* in FIG. 5 are thus generated by the embodiment in accordance with FIG. 7. The capacitor 27 is charged via a circuit, and the thyristor 29 will open on the discharge of said capacitor to the dust separator. When the thyristor 29 opens, energy will flow from the capacitor 27 to the dust separator 2 via the inductance 33 and back via the diode 28, in the manner illustrated in FIG. 5. At a time t5 the oscillation process will be stopped in the manner already referred to, by means of a signal via the conductor 30.

The method of arranging the energy supply in accordance with the present invention is particularly suitable for a controlled damped oscillation by means of which the oscillating energy can be utilized in sequence in an efficient fashion.

It should be noted that any conventional sensing circuit could be utilized for the purpose of determining the value of the curve 20', in each case at every interval of time which is of interest. It should also be possible to determine the flashover discharge value of, for example, the first pulse by permitting it to increase for certain intervals of time and by then establishing whether or not the increased value produces a flashover discharge.

The duration of the pulses, in particular in the self-oscillating voltage, may be varied by selecting different capacitance values and different inductance values for the circuit.

Finally, it must be stated that the value of the second level 20' may be regarded as being dependent upon the shape of the pulse (amplitude, pulse width). Accordingly, this value should normally be higher for pulses with a low energy content (small duration compared with pulses with a high energy content).

With regard to FIG. 5, it is stated that the whole of the superimposed voltage must lie above the d.c. voltage value, although there is nothing to prevent the introduction of a change whereby only a part of the voltage, and preferably the greater part, may be made to lie above the d.c. voltage value.

I claim:

1. A method for varying a d.c. voltage connected to electrodes in an electrostatic dust separator to render it more effective in return for a low consumption of energy and high collection of dust on one of said electrodes incorporated in the dust separator, wherein the d.c. voltage has a first basic d.c. level, superimposing on said d.c. level a plurality of voltage pulses forming a pulse group, with the consecutive pulses being separated from each other by a time interval, supplying said voltage to the electrodes in the dust separator, wherein said superimposing of pulses is accomplished by generating a plurality of pulses making up a pulse group, and selecting the configuration of the first pulse in said pulse group so as to have an amplitude and a duration and a form such that, when the pulse is supplied to the dust separator, it will not cause flash-over but will produce an increase in the tendency to flash-over of the dust separator, and selecting the configuration of each succeeding pulse in said pulse group so as to have an amplitude and a duration and a form such that, when each of said succeeding pulses is supplied to the dust separator, it will not cause flash-over in spite of the temporary increased tendency to flash-over which is caused by the preceding pulse.

2. A method in accordance with claim 1, wherein the configuration of each pulse in the pulse group is selected so that its peak voltage value is below by only a small amount the level which would cause flash-over for said peak voltage value at its time of occurrence.

3. A method in accordance with claim 1, wherein the configuration of each pulse in the pulse group is selected so as to exhibit an energy content exceeding the energy content of the immediately following pulse in the pulse group.

4. A method in accordance with claim 1, wherein the duration of time for each pulse is selected so as to be not greater than the interval of time between two immediately consecutive pulses within the pulse group.

5. A method in accordance with claim 1, wherein the peak voltage value for each pulse within one and the same pulse group is a successively and progressively reducing value.

6. A method in accordance with claim 1, wherein when selecting the configuration of each succeeding pulse, at least one of the interval of time between immediately consecutive pulses within a pulse group, the number of immediately consecutive pulses within the pulse group, and the amplitude of each pulse is regulated.

7. A method in accordance with claim 1, wherein each pulse within a pulse group is generated by a subcritically damped LC oscillating circuit, the capacitance of the dust separator accounting for a significant part of the capacitance value of the oscillating circuit, and the pulse group is generated by a subcritically damped LC circuit.

8. A method in accordance with claim 7, wherein the duration and the amplitude of the pulse are selected by selecting the values for the components the LC circuit.

9. A method in accordance with claim 7, wherein a portion of the pulses within the pulse group which makes only a small contribution to the separation of the dust is clipped.

10. A method in accordance with claim 1, wherein any increase in the d.c. voltage in the dust separator caused by the pulse group and occurring after the pulse group, is allowed to fall to a predetermined level for the d.c. voltage before a further pulse group is activated.

11. A device for controlling a variation of a d.c. voltage connected to electrodes in an electrostatic dust separator with at least two electrodes incorporated in the dust separator, the d.c. voltage between the at least two electrodes having a first basic d.c. level, a pulse generating device superimposing consecutive pulse groups on said d.c. voltage, each said pulse group comprising a plurality of voltage pulses, with the consecutive pulse groups being separated from each other, said pulse generating device being arranged to generate a number of pulses making up said pulse groups so that the first pulse in each pulse group has an amplitude and a duration and a form so that, when the pulse is supplied to the dust separator, it will not cause flash-over but will produce an increase in the tendency to flash-over of the dust separator, and so that each succeeding pulse in the pulse group has an amplitude and a duration and a form so that, when each of the succeeding pulses is supplied to the dust separator, it will not cause flash-over in spite of the temporary increased tendency to flash-over caused by the preceding pulse.

12. A device in accordance with claim 11, including control means to provide each pulse in the pulse group with an energy content immediately below the amount of energy content which would cause flash-over at the actual level of tendency to flash-over.

13. A device in accordance with claim 11, wherein the pulse generating device is constructed so as to control the energy content for each pulse in the pulse group and the energy content for each pulse is selected so as to exhibit an energy content exceeding the energy content of the immediately following pulse in the pulse group.

14. A device in accordance with claim 11, wherein the pulse generating device is arranged to generate pulses within the pulse group with a pulse duration which is not greater than the interval of time between two immediately consecutive pulses.

15. A device in accordance with claim 11, wherein the pulse generating device is arranged to generate pulses within the pulse group, whereby the peak amplitude of the voltage for each pulse is progressively reduced in the group.

16. A device in accordance with claim 11, wherein the pulse generating device is arranged to control pulses generated within the pulse group so that each pulse has a different duration.

17. A device in accordance with claim 11, wherein the pulse generating device is arranged to control pulses generated within the pulse group so that there are different intervals of time between consecutive pulses.

18. A device in accordance with claim 11, wherein the pulse generating device is arranged to control pulses generated within the pulse group so that they have different amplitudes.

19. A device in accordance with claim 11, wherein the pulse generating device is arranged to control pulses generated within the pulse group so that they have a variable time interval between pulse groups which follow each other.

20. A device in accordance with claim 11, wherein the pulse generating device is so arranged as to control the switching in of an oscillating voltage.

21. A device in accordance with claim 20, wherein the pulse generating device comprises a subcritically damped LC oscillating circuit, with the capacitance of the dust separator representing a significant proportion of the capacitance value of the oscillating circuit.

22. A device in accordance with claim 20, wherein said pulse generating device comprises an oscillating circuit having the frequency of the oscillating voltage generated by said oscillating circuit and the duration of the pulses matched to a second oscillating circuit incorporating the capacitance of the dust separator and an inductance.

23. A device in accordance with claim 22, wherein said inductance is in the form of a separate inductance connected in the second oscillating circuit.

24. A device in accordance with claim 22, wherein said inductance is the impedance of a transformer.

25. A device in accordance with claim 11, wherein the pulse generating device is so arranged that, after the elapse of pre-determined period, it clips a part of a decaying component of the pulse group.

26. A device in accordance with claim 11, wherein the pulse generating device is so arranged as to control the switching in of a number of additional pulses in a subsequent pulse group only after the voltage level, which is increased by the pulses in the first group and gradually diminishes after termination of said pulses, has fallen to the first basic level.

* * * * *